US009090055B2

(12) United States Patent
Van Der Meulen et al.

(10) Patent No.: US 9,090,055 B2
(45) Date of Patent: Jul. 28, 2015

(54) VARIABLE FORMAT OFFSET PRINTING MACHINE HAVING A CENTRAL IMPRESSION CYLINDER

(75) Inventors: Michiel Van Der Meulen, Arnhem (NL); Adelbert Lucas Schoonman, Eerbeek (NL); Luis Antonio Ruiz Suesa, Barcelona (ES); Jordi Puig Vila, Bescanó (ES); Lluis Puigdemont, Porqueres (ES)

(73) Assignee: NEOPACK S.L. (ES)

( * ) Notice: Subject to any disclaimer, the term of this patent is extended or adjusted under 35 U.S.C. 154(b) by 200 days.

(21) Appl. No.: 13/883,491

(22) PCT Filed: Oct. 18, 2011

(86) PCT No.: PCT/IB2011/002475

§ 371 (c)(1),
(2), (4) Date: Jun. 26, 2013

(87) PCT Pub. No.: WO2012/059801

PCT Pub. Date: May 10, 2012

(65) Prior Publication Data

US 2013/0276651 A1 Oct. 24, 2013

(30) Foreign Application Priority Data

Nov. 5, 2010 (EP) ..... 10014329

(51) Int. Cl.

| | |
|---|---|
| ***B41F 7/02*** | (2006.01) |
| ***B41F 13/193*** | (2006.01) |
| ***B41F 7/10*** | (2006.01) |

(Continued)

(52) U.S. Cl.

CPC ..... *B41F 13/193* (2013.01); *B41F 7/10* (2013.01); *B41F 13/0024* (2013.01); *B41F 13/20* (2013.01); *B41F 13/30* (2013.01); *B41F 13/44* (2013.01)

(58) Field of Classification Search

USPC ..... 101/217

See application file for complete search history.

(56) References Cited

U.S. PATENT DOCUMENTS 4,936,211 A * 6/1990 Pensavecchia et al. ..... 101/136
5,339,731 A 8/1994 Howard et al.

(Continued)

FOREIGN PATENT DOCUMENTS

EP 0545862 A1 6/1993
EP 0656259 A1 6/1995

(Continued)

*Primary Examiner* — Anthony Nguyen

(74) *Attorney, Agent, or Firm* — Hess Patent Law Firm LLC; Robert J. Hess

(57) ABSTRACT

The printing machine has a central impression cylinder (1) on which a web printable substrate (B) is supported and a plurality of printing stations arranged around the central impression cylinder (1). Each printing station includes a blanket cylinder (2) of variable diameter, a plate cylinder (3) of variable diameter, and an offset inking unit (4). The blanket cylinder (2), plate cylinder (3) and offset inking unit (4) are individually movable between respective withdrawn positions and respective multiple working positions for different diameters of the blanket and plate cylinders (2, 3). At least one of the printing stations has the axis of the blanket cylinder (2) and the axis of the plate cylinder (3) in an inclined first plane (P1), which does not include the axis of the central impression cylinder (1) at any of the multiple working positions for different diameters of the blanket and plate cylinders (2, 3).

18 Claims, 7 Drawing Sheets

(51) Int. Cl.

| | |
|---|---|
| ***B41F 13/00*** | (2006.01) |
| ***B41F 13/20*** | (2006.01) |
| ***B41F 13/30*** | (2006.01) |
| ***B41F 13/44*** | (2006.01) |

(56) References Cited

U.S. PATENT DOCUMENTS

| | | | | |
|---|---|---|---|---|
| 5,370,047 | A | 12/1994 | Compton | |
| 5,697,296 | A * | 12/1997 | Thunker et al. | 101/216 |
| 6,401,608 | B1 * | 6/2002 | Lyon et al. | 101/136 |
| 6,928,928 | B1 * | 8/2005 | Schmid | 101/183 |
| 2002/0043165 | A1 * | 4/2002 | Williams | 101/177 |
| 2006/0150838 | A1 * | 7/2006 | Hollings et al. | 101/180 |

FOREIGN PATENT DOCUMENTS

| | | | |
|---|---|---|---|
| ES | 2319952 | A1 | 5/2009 |
| WO | 2012/059801 | A1 | 5/2012 |

* cited by examiner

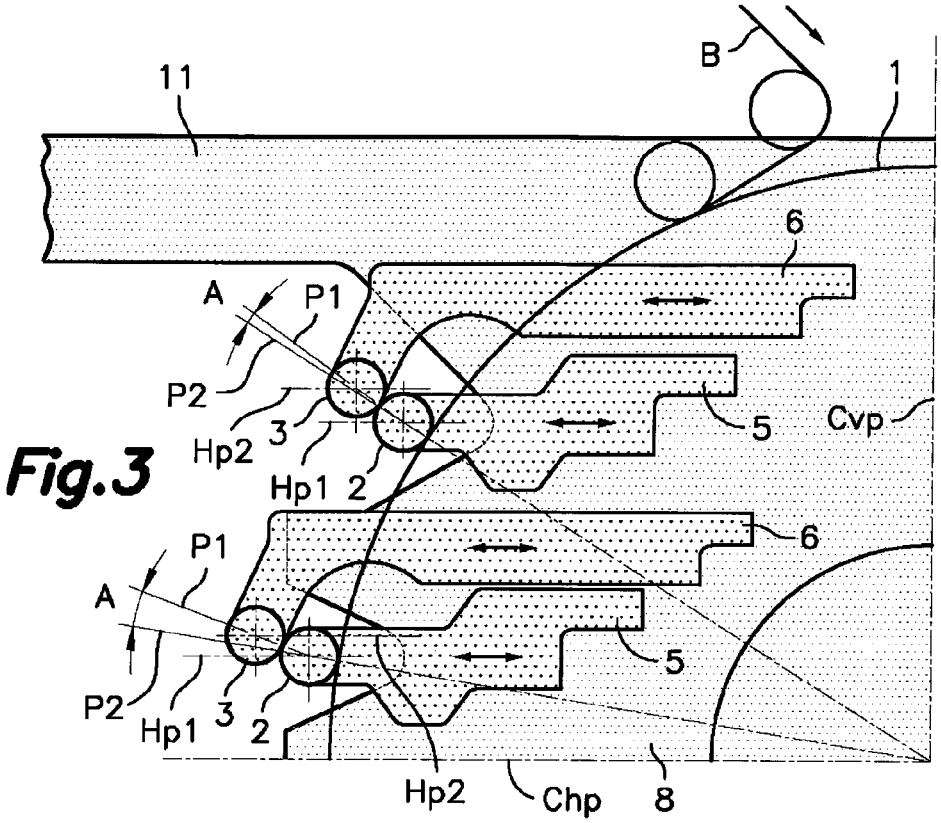
Fig.3
Fig.4
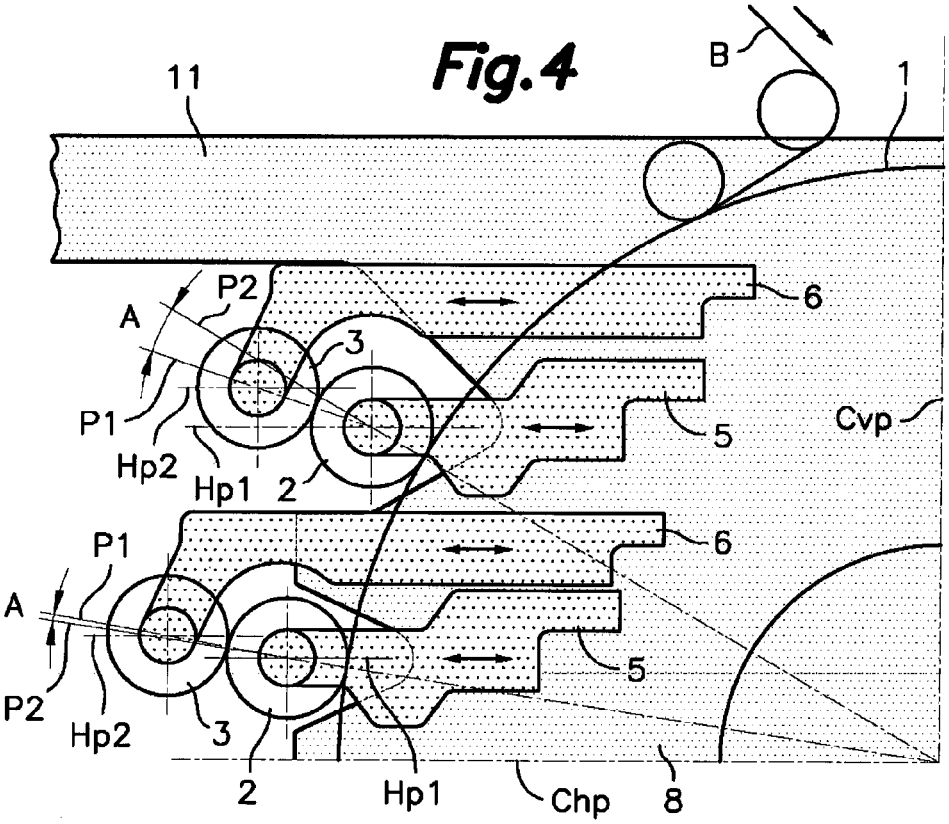

VARIABLE FORMAT OFFSET PRINTING MACHINE HAVING A CENTRAL IMPRESSION CYLINDER

TECHNICAL FIELD

The present inventions relates to a web offset printing machine having a central impression cylinder and a plurality of printing stations arranged around said central impression cylinder, where the printing stations can be adjusted to work with printing cylinders of different diameters allowing variable format, in other words variable repeat lengths.

BACKGROUND OF THE INVENTION

Flexographic and gravure printing were the traditional and long-time processes for printing on flexible substrates for packaging, labels, bags and the like. In the recent years, volumes of individual printing jobs went down from over multiple 100.000 of copies to several 1000 copies. This tendency is growing and is driven by the need to prevent dead capital in printed stock and by the need for quick reaction on events in the form of action packs and the higher degree of diversity of packed products. These new demands from the market made clear that flexographic and gravure printing have several shortcomings to match with these new demands:

1) Print form costs per square meter printed substrate are too high for medium and short run jobs. The image carriers or clichés used in flexographic and gravure printing are expensive, which increase the square meter price of the printed substrate up to unacceptable levels.

2) Production time of the print form is too long with respect to actual demands. The production of the printing forms used in flexographic and gravure printing is time consuming, which has a negative impact on the flexibility of the printing process (job shifts are time consuming) and on time-to-market, and can create long down time of the press.

3) Environmental issues due to solvents and energy consumption. The inks used by flexographic and gravure printing are mainly solvent based, being VOC's (Volatile Organic Compounds) like toluene or water. There is a strong environmental impact from the VOC's, and blowing off is not longer allowed. Regeneration of the VOC's is possible but only at high additional costs. In case of water-based inks, taking the water from the ink goes only with high energy consumption, therefore also very high costs.

The three previously mentioned main disadvantages are completely solved with the introduction of web-offset printing in combination with radiation curing ink technology and making use of easy exchangeable printing cylinders allowing variable repeat lengths. The advantages are as follows:

1) Low cost image carrier (offset plate). The cost of an image carrier (offset plate) in offset is much lower in comparison with a flexographic cliché or an engraved cylinder for gravure printing.

2) Very fast production of image carrier (offset plate). Short pre-press times for production of offset printing plates is a second important advantage over the traditional printing processes like flexographic and gravure.

3) No solvents involved. UV (Ultraviolet) and EB (Electron Beam) curable inks are used for offset printing which, when cured, are 100% converted from liquid into solid state without any use, or loss, of solvents.

For example patent EP1101611 discloses a web-offset printing machine for printing on flexible substrates making use of easy exchangeable lightweight printing cylinders (sleeves) which are individually servo driven for variable repeat lengths, and making use of UV or EB curable inks. Web-offset printing machines built according to the previous patent or with similar characteristics, are designed as in-line printing machines, meaning all printing stations lay in the same horizontal level. In between offset printing stations the web printable substrate is not supported in any way. For a controlled transport of the web from one offset printing station to the next, and for accurate color-to-color print register, the in-line printing machine configuration requires a certain minimum web-tension. Under these circumstances thinner substrates with high elasticity, like for example PE (Polyethylene) and CPP (Cast Polypropylene), have the tendency to stretch more then acceptable, with a short image and poor color-to-color register as a result. For these reasons the in-line printing machine configuration is only suitable for a limited amount of substrates, with a low elasticity, like for example PET (Polyethylene Terephthalate) and OPP (Oriented Polypropylene) amongst others.

In flexographic printing it is common use to arrange the flexographic printing stations around a central impression cylinder. The advantage of a central impression cylinder is that a high elastic substrate, once it is positioned onto the surface of the central impression cylinder, is more or less fixed and therefore the web printable substrate doesn't stretch during printing, resulting in a correct repeat length and accurate color-to-color register.

An obvious solution to combine offset printing with a central impression cylinder would be to position the offset printing cylinders and the offset printing station in a radial way around the central impression cylinder. In this situation the axes of plate and blanket cylinders of each printing station are exactly or almost exactly in the same plane than the axis of the central impression cylinder, which is an advantage for quality printing in regard to gap-bounce issues. But with the provision of at least 6 to 8 printing stations on average for packaging and label printing and the necessary scale of printing cylinders and printing stations required by market (speed) and quality (stability) demands, this would have a negatively impact on the total height of the press.

Patent ES-A-2319952 discloses a printing machine comprising a plurality of offset printing stations arranged around a central impression cylinder. Each printing station comprises a blanket cylinder supported on a first support, a plate cylinder supported on a second support and an offset inking unit supported on a third support, wherein said first, second and third supports are linearly movable in horizontal directions between respective withdraw positions and respective multiple working positions able to accommodate and work with pairs of blanket and plate cylinders of different diameters to allow a variable repeat length. Such a horizontal linear displacement of the blanket and plate cylinders and offset inking units is advantageous to keep the total height of the press within desirable limits. The horizontal movement of the offset printing cylinders and offset printing stations also allows for identical construction of all the printing stations, reducing the total amount of different parts, which is a clear advantage regarding costs and logistics.

However, a drawback with cited patent ES-A-2319952 is that the axes of the plate cylinder and blanket cylinder of each printing station are comprised in a horizontal plane while the axes of the blanket cylinder and central impression cylinder are comprised on an inclined plane which forms an angle with the horizontal plane that is greater the higher or lower is the position of the printing station with respect to the axis of the central impression cylinder. The greater is said angle the more sensitive is a minimal movement of the cylinders caused by so called gap-bounce consisting of a short and sudden drop and rise of the pressure between the printing cylinders when a gap existing in a blanket supported on the blanket cylinder passes through the nip with the plate cylinder and through the nip with the central impression cylinder. This movement can cause stripes in the print.

U.S. Pat. No. 718,172 discloses a variable format offset printing machine having a plurality of left and right stacked opposite printing stations arranged to print on both sides of a web printable substrate passing through the nip of pairs of blanket cylinders of the opposite pairs of printing stations. Therefore, there is neither a central impression cylinder nor individual impression cylinders. The opposite blanket cylinders of the left and right printing stations are mounted on a fixed central frame and the plate cylinders together with the corresponding offset inking units of the left and right printing stations are mounted on respective left and right frames horizontally movable between withdrawn and working positions with respect to the fixed central frame. Thus, when the left and right frames are in their withdrawn positions a clear access is provided to the blanket and plate cylinders.

A drawback with the cited U.S. Pat. No. 718,172 printing machine is that there is no access to the rollers and other components of the offset inking units neither with the left and right frames in their withdrawn or working positions. If both blanket and plate cylinders of each printing station were mounted on the fixed central frame, then no good accessibility is provided for changing the format, i.e. replacing the pairs of blanket and plate cylinders by others having a different diameter. Additionally, the printing machine of cited U.S. Pat. No. 718,172 has the drawbacks related with the lack of central impression cylinder when working on a high elastic web substrate, as discussed above.

DISCLOSURE OF THE INVENTION

The present invention provides a printing machine combining the advantages of radiation curing offset printing with the advantages of a central impression cylinder design. The printing machine of the invention comprises a central impression cylinder on which a web printable substrate is supported and a plurality of printing stations arranged around said central impression cylinder. Each of said printing stations comprises a blanket cylinder of variable diameter, a plate cylinder of variable diameter, and an adaptable offset inking unit. The axes of said blanket cylinder, of said plate cylinder and of a plurality of inking rollers of the offset inking unit are parallel to the axis of the central impression cylinder.

In at least one of said printing stations, the axis of the blanket cylinder and the axis of the plate cylinder are comprised in an inclined first plane which does not comprise the axis of the central impression cylinder at any of said multiple working positions for different diameters of the blanket and plate cylinders. Said first plane comprising the axes of the plate and blanket cylinders forms an angle ranging from 0° to 20°, and more preferably from 0° to 15°, with a second plane comprising the axis of the central impression cylinder and the axis of the blanket cylinder at any of said multiple working positions for different diameters of the blanket and plate cylinders. An angle no more than 20° is considered to be acceptable for quality printing in regard to the gap-bounce effect.

The blanket cylinder, plate cylinder and offset inking unit are individually movable between respective withdraw positions and respective multiple working positions for accommodating and work with different diameters of the blanket and plate cylinders. At any of said working positions, the blanket cylinder is in contact with the web printable substrate supported on the central impression cylinder, the plate cylinder is in contact with the blanket cylinder and the inking rollers of the offset inking unit are in contact with the plate cylinder. Preferably, the axis of the blanket cylinder and the axis of the plate cylinder are movable in respective parallel planes and in directions perpendicular to the axis of the central impression cylinder. More preferably said parallel planes are first and second horizontal planes, respectively.

The degree of inclination of said first plane comprising the axes of the plate cylinder and blanket cylinder is variable depending on the diameter of the pair of plate and blanket cylinders in combination with the linear horizontal positioning movement thereof. Since said second plane comprising the axes of the central impression cylinder and blanket cylinder is usually also an inclined plane having a variable inclination depending on the higher or lower position of the corresponding printing station with respect to the central horizontal plane comprising the axis of the central impression cylinder, the positions of the horizontally moving blanket and plate cylinders in each printing station and the positions of the printing stations around the central impression cylinder are selected such that the combined inclinations of the first and second planes for all the printing stations and for all the diameters of the pairs of blanket and plate cylinder give an angle therebetween as little as possible, and in any case no more than 20° and preferable no more than 15°.

In a particular case where the axes of the central impression cylinder, blanket cylinder and plate cylinder are comprised in one and the same plane is an ideal situation regarding the gap-bounce effects reduction, which only is achieved with the printing stations positioned in a radial arrangement having the drawback of unacceptable machine overall volume. With printing stations having the blanket cylinder and plate cylinder moving in horizontal planes, this ideal situation only is done when the axes of the central impression cylinder, blanket cylinder and plate cylinder are comprised in a central horizontal plane.

For the rest of printing stations located above or below said central horizontal plane, the fact of not exceeding in any case an angle of 20° between the first and second planes is an acceptable compromise taking into account the benefits in the machine operation and overall volume reduction, among others, achieved by using linear horizontal positioning movement for the blanket and plate cylinders and offset inking units of printing stations located around a central impression cylinder.

It is also advantageous in the printing machine of the present invention the fact of having all the offset inking units horizontally positioned and horizontally movable in comparison to having all the offset inking units radially positioned and radially movable. With horizontally positioned and horizontally movable offset inking units all the offset inking units can have an exact identical configuration and position of all their rollers, which secures an identical ink flow and printing behavior and thus an identical print quality. Furthermore, identical offset inking units are easier to operate and to control. On the contrary, with radially positioned offset inking units the ink flow is in some units upwards, in some units downwards and in some units more or less horizontal causing different process circumstances with quality differences as a result.

A further advantage of having all the offset inking units horizontally positioned, in comparison to having all the offset inking units radially positioned, is the limited amount of different covers needed to close the openings between the adjacent and horizontally moving offset inking units. In addition, the complexity of the necessary covers is less with horizontally positioned and moveable offset inking units in comparison to radially positioned and moveable offset inking units.

In the printing machine of the present invention, the central impression cylinder is rotatingly supported on a middle region of a main frame having a gear side and an opposed operator side, as well as a web inlet side where the web printable substrate comes in contact with the central impression cylinder and an opposed web outlet side where the web printable substrate leaves the central impression cylinder. Each printing station comprises a first support for rotatingly supporting the blanket cylinder, a second support for rotatingly supporting the plate cylinder. Said first and second supports are directly connected to said middle region of the main frame by respective first and second horizontal linear guidance means. Thus, by moving the first and second supports between withdrawn and working positions the blanket cylinder and plate cylinder of the corresponding printing station are moved between their corresponding withdrawn and working positions.

Another significant inventive feature of the present invention is an advantageous way to arrange and operate offset inking units horizontally positioned and horizontally movable in the corresponding printing stations located around the central impression cylinder. Different from the relatively small flexographic inking units using inking chamber in flexographic printing machines or gravure inking units using ink pan in gravure printing machines, the offset inking unit of an printing station is relatively voluminous and consists of a plurality of different rollers, an ink fountain and a dampening system. The fact of having all the elements of each offset inking unit arranged in one auxiliary frame enables the whole offset inking unit to be perfectly positioned in relation to the corresponding plate cylinder.

In the printing machine of the present invention, the offset inking units of all the printing stations which are located at one and the same web inlet or web outlet side of the central impression cylinder are mounted on one auxiliary frame connected by third horizontal linear guidance means to the corresponding upper beam extending from the middle region of the main frame and by fourth horizontal linear guidance means to the corresponding lower beam extending from the middle region of the main frame. The offset inking units are superposed on one another in the auxiliary frame and staggered so as to follow the circumference of the central impression cylinder. Thus, by moving said auxiliary frame between withdrawn and working positions all the offset inking units located in the same web inlet or web outlet side are jointly moved between their respective withdrawn and working positions. The offset inking units comprise adjusting means well known in the art for adjusting the positions of the inking rollers to plate cylinders of different diameters when the auxiliary frame is in one of its working positions.

One advantage of the horizontally movable auxiliary frame on which the offset inking units are horizontally staked is that, when the auxiliary frame is in its fully opened withdraw position, enough space is provided between the auxiliary frame and all the first and second supports located at the same corresponding web inlet or web outlet side to create a free and easy access for an operator therein, thereby providing a clear access to the rollers and other components of the offset inking units and to the blanket and plate cylinders of all the printing stations located at the corresponding web inlet or web outlet side for inspection or maintenance.

Existing offset printing machines having a central impression cylinder lack this free access for an operator, with a more difficult and time consuming operation, adjustment, cleaning and maintenance as a result. Commonly known and used central impression cylinder flexographic printing machines do not need to meet the requirements of moving auxiliary frames for easy access because of their simple design with relatively few and small components involved. Simply moving the flexographic inking chamber away from the central impression cylinder creates sufficient space for cleaning and maintenance. Therefore it is common practice in central impression cylinder flexographic printing machines that the flexographic inking units are moveably mounted onto the same main frame carrying the central impression cylinder.

A further advantage of the horizontally movable auxiliary frame on which the offset inking units are horizontally staked is that an alternative inking unit can be used in one or more of the printing stations when the corresponding offset inking unit is in the withdrawn position. If necessary, the blanket and plate cylinders may be replaced in the corresponding first and second supports by other printing cylinders appropriate for working with the alternative inking unit.

To that end, the auxiliary frame is comprised of a plurality of modular auxiliary frame parts staked on one another and connected to each other, wherein each modular auxiliary frame part carries one or more of the offset inking units. The position of one or more of said staked modular auxiliary frame parts, for example that modular auxiliary frame part which carries the uppermost inking unit of the stack, is shiftable with respect to the rest of the staked modular auxiliary frame parts forming the auxiliary frame, thus enabling that modular auxiliary frame part to be maintained in its withdrawn position to provide sufficient room for the alternative inking unit while the rest of modular auxiliary frame parts are in their working positions.

For the purpose of easy construction and reduction of the number of different parts, each offset inking unit is preferably installed in one of the modular auxiliary frame parts and all the modular auxiliary frame parts are identical and shiftable with respect to each other. The uppermost and lowermost modular auxiliary frame parts of the stack are respectively connected to the corresponding upper and lower beams of the main frame by said third and fourth horizontal linear guidance means, and locking means are provided for selectively locking the movement between adjacent modular auxiliary frame parts. Thus, the stacked modular auxiliary frame parts forming the auxiliary frame can be moved individually or as one unit between their withdrawn and working positions.

This arrangement allows exact identical offset inking units to be arranged horizontally around a central impression cylinder, with an optimal positioning around a range of central impression cylinders varying in diameter from a minimum to a maximum value. It also allows modularity and reuse of identical parts, and creates flexibility for individual positions of the offset inking units by the possibility of relative movement between their respective modular auxiliary frame parts. Optionally, one or more of the stacked modular auxiliary frame parts forming the auxiliary frame on which the offset inking units are mounted can be replaced with dummy modular auxiliary frame part to allow a limited number of printing stations instead of the maximum possible number and/or to allow space for additional drying or curing equipment.

BRIEF DESCRIPTION OF THE DRAWING

The above and other features and advantages will become apparent from the following detailed description of exemplary embodiments with reference to the accompanying drawings, in which:

FIG. 3 is a diagrammatic partial operator side view showing a first and a second offset printing stations with respect to the movement direction of a web printable substrate supported on the central impression cylinder, with the first and a second offset printing stations positioned in respective first working positions suitable for pairs of blanket and plate cylinders of minimum format;

FIG. 4 is a diagrammatic partial operator side view showing the first and second offset printing stations positioned in a second working position suitable for pairs of blanket and plate cylinders of maximum format;

DETAILED DESCRIPTION OF EXEMPLARY EMBODIMENTS

Figure 1:
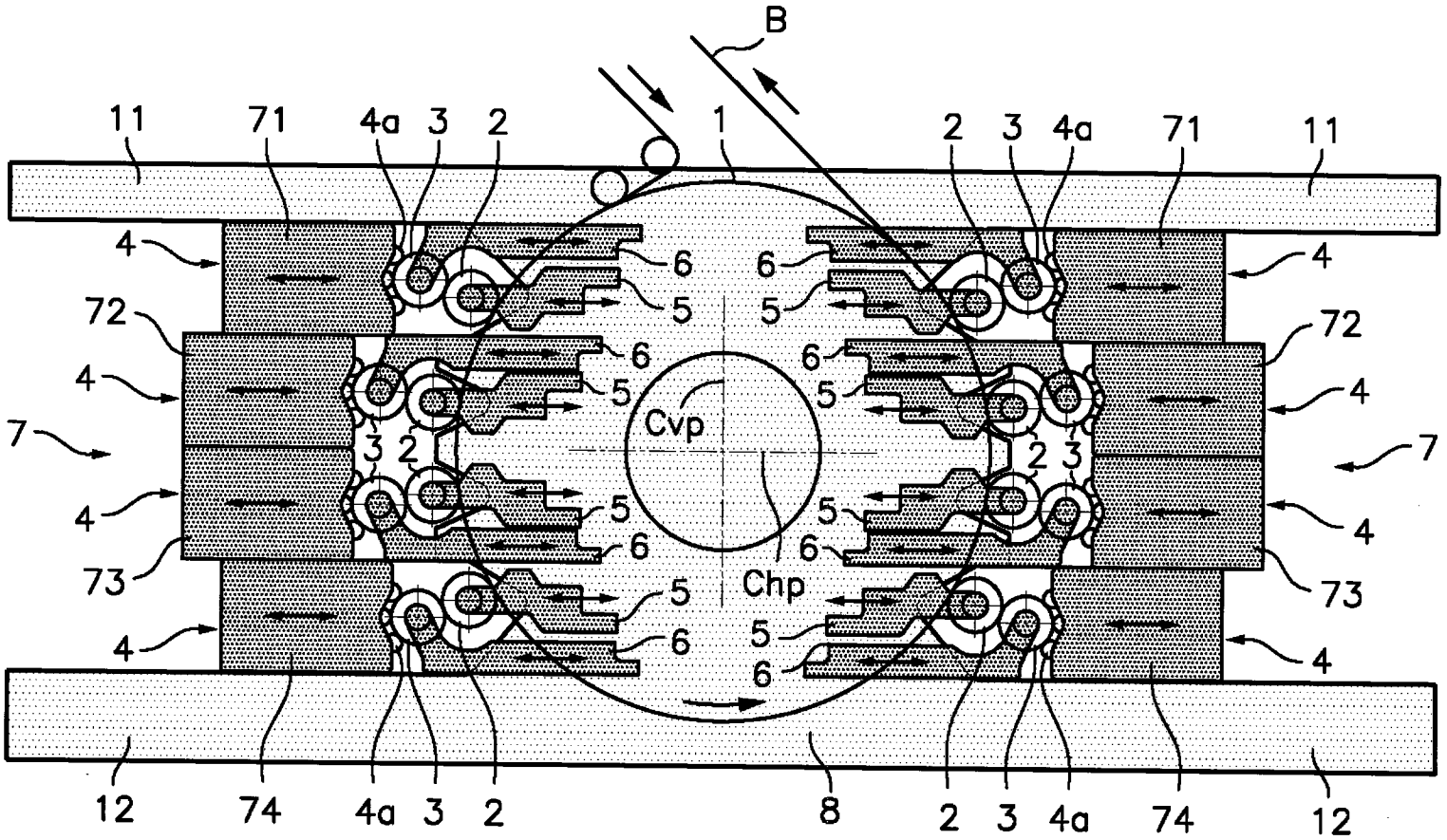
FIG. 1 is a diagrammatic operator side view of a variable format offset printing machine having a central impression cylinder according to an exemplary embodiment of the present invention with the offset printing stations in a working position.
Figure 2:
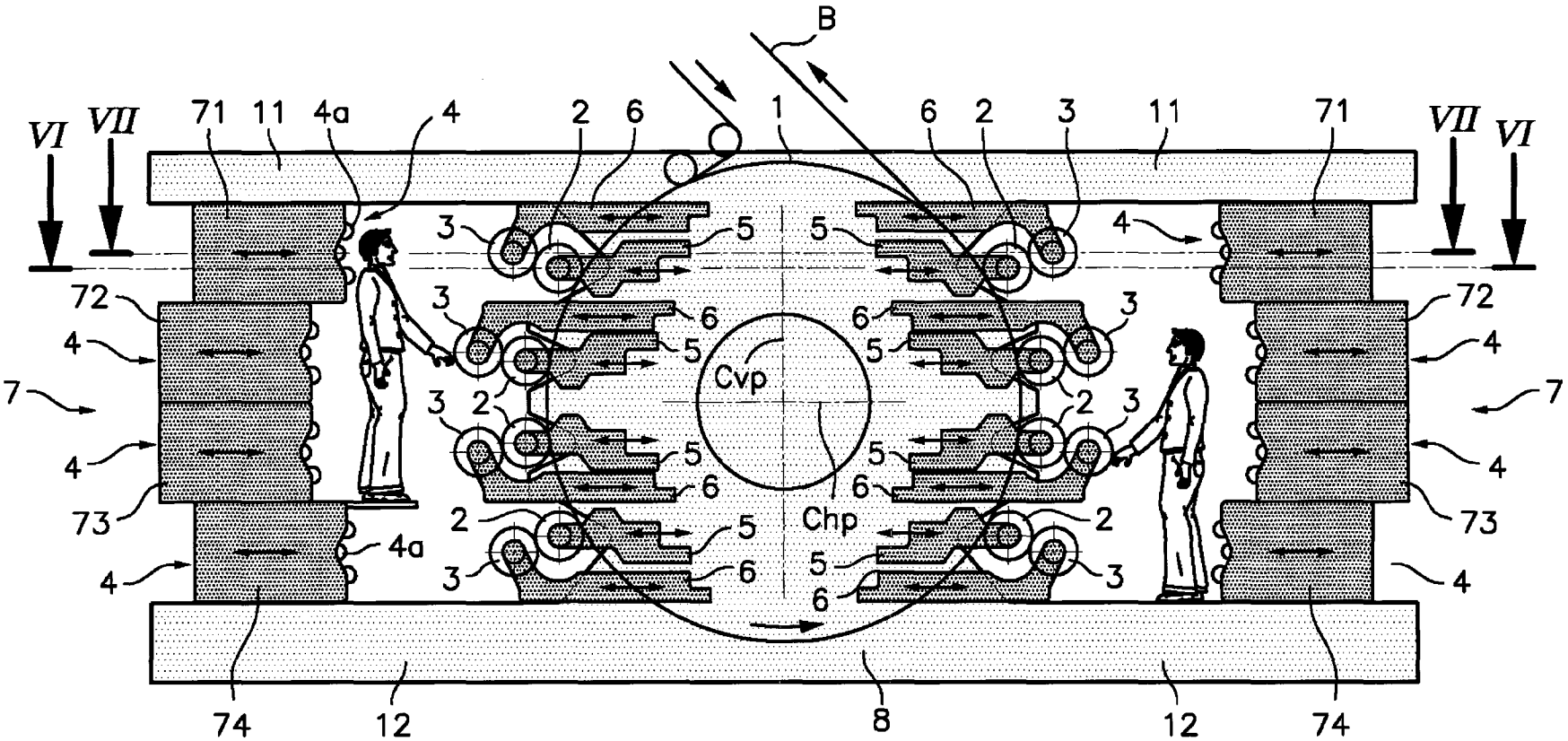
FIG. 2 is a diagrammatic operator side view of the offset printing machine of FIG. 1 with the printing stations in a withdrawn position.

Referring first to FIGS. 1 and 2, there is shown an offset printing machine according to an exemplary embodiment of the present invention. The offset printing machine comprises a main frame 8 supporting a rotatable central impression cylinder 1 on which a web printable substrate B is supported and a plurality of printing stations arranged around said central impression cylinder 1. In operation, the central impression cylinder 1 rotates in the direction indicated by an arrow (counter clockwise in the Figures) and the web printable substrate B moves in the direction indicated with arrows as the central impression cylinder 1 rotates and comes in contact with the central impression cylinder 1 at a web inlet side thereof (left side in the Figures) and leaves the central impression cylinder 1 at an opposite web outlet side thereof (right side in the Figures). More specifically, in the illustrated exemplary embodiment there are four of said printing stations arranged at said web inlet side and other four printing stations arranged at said web outlet side.

Each printing station comprises a blanket cylinder 2, a plate cylinder 3 and an offset inking unit 4. The axes of said blanket and plate cylinders 2, 3 and of a plurality of inking rollers 4*a* of said offset inking unit 4 are parallel to the axis of the central impression cylinder 1. Each blanket cylinder 2 is supported on a particular first support 5 and each plate cylinder 3 is supported on a particular second support 6. Said first and second supports 5, 6 are directly connected to a middle region of the main frame 8 by means of respective first and second horizontal linear guidance means 20*a*, 20*b*, 21*a*, 21*b*; 22*a*, 22*b*, 23*a*, 23*b* (described in more detail with reference to FIGS. 5, 6 and 9) and driven by driving means so that the first and second supports 5, 6 and the corresponding blanket and plate cylinders 2, 3 are individually linearly movable in horizontal directions perpendicular to the axis of the central impression cylinder 1 between respective withdraw positions, and respective multiple working positions in which the blanket and plate cylinders 2, 3 are in their withdraw positions and multiple working positions, respectively.

Figure 7:
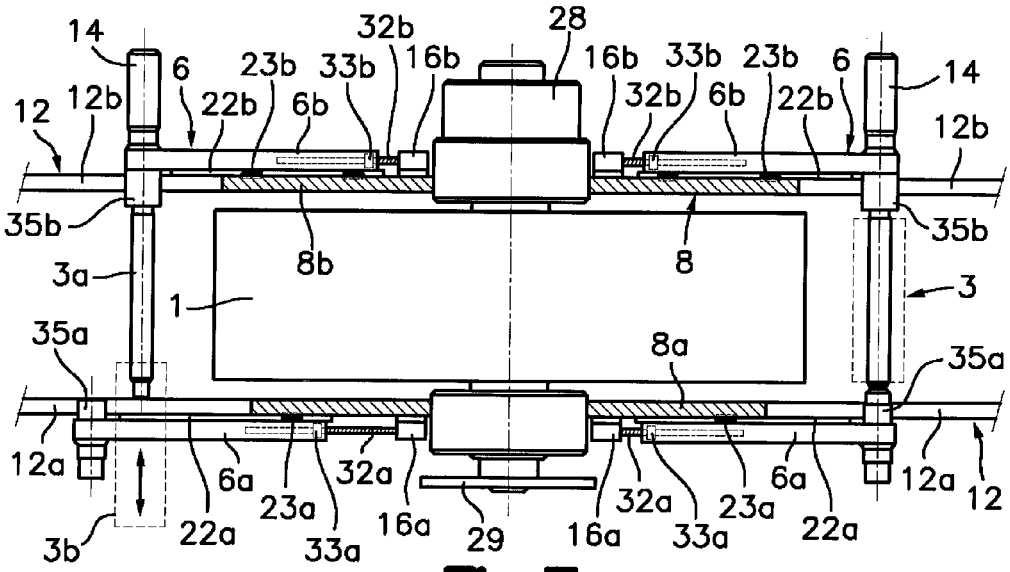
FIG. 7 is a is a partial cross-sectional view taken along the plane VII-VII of FIG. 2 showing the construction of the main frame supporting the central impression cylinder and one of the second supports carrying a plate cylinder.
Figure 8:
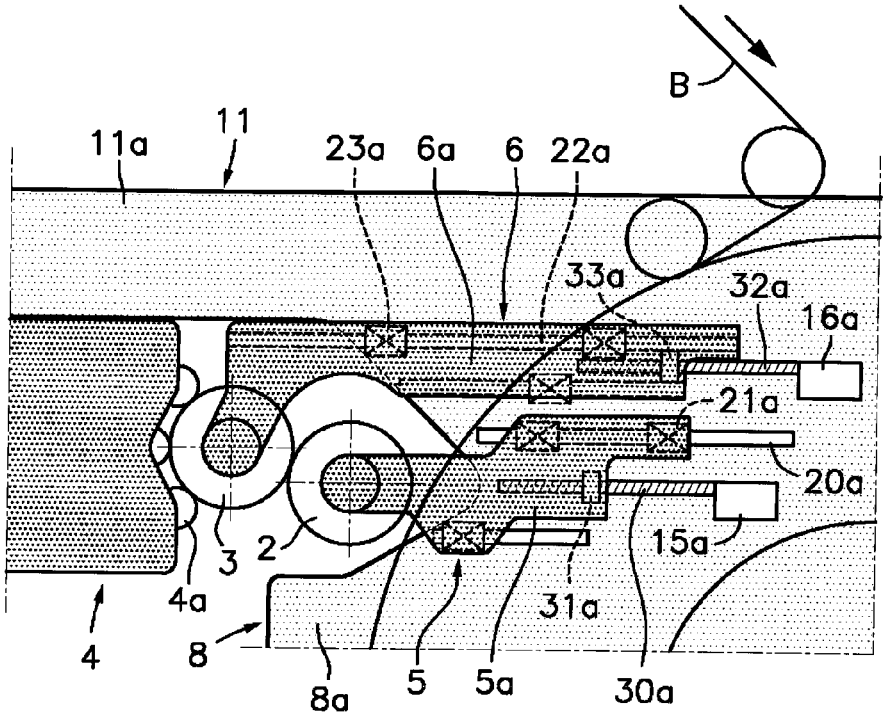
FIG. 8 is a diagrammatic partial operator side view showing horizontal linear guidance means for the first and second supports.

The offset inking units 4 of all the printing stations which are located at one and the same web inlet side or web outlet side of the central impression cylinder 1 are installed on an auxiliary frame 7 which is connected at its top by third horizontal linear guidance means 24, 25 to upper beams 11 extending from the middle region of the main frame 8 and at its bottom by fourth horizontal linear guidance means 26, 27 to lower beams 12 extending from the middle region of the main frame 8 (see also FIGS. 7 and 8). Said upper and lower beams 11, 12 are rigidly connected to the main frame 8 and belong thereto. The offset inking units 4 are superposed to one another in each auxiliary frame 7 and slightly staggered following the diameter of the central impression cylinder.

The auxiliary frames 7 are driven by driving means so that they are movable in horizontal directions perpendicular to the axis of the central impression cylinder 1 between respective withdraw positions in which the offset inking units 4 are in their withdraw positions (FIG. 2) and respective multiple working positions (FIG. 1) in which the offset inking units 4 are in their multiple working positions, respectively.

To vary the format, i.e. the repeat length, it is necessary to replace the pairs of blanket and plate cylinders 2, 3 having a particular diameter with pairs of blanket and plate cylinders 2, 3 having a new diameter, adjust the positions of a plurality of inking rollers 4*a* of the offset inking units 4 to conform to the new diameter of the plate cylinder 3, and then adjust the working positions of the first and second supports 5 and auxiliary frame 7 by linearly moving them in the horizontal directions to put the blanket and plate cylinders 2, 3 and the inking rollers 4*a* of the offset inking unit 4 in good condition for working therebetween and with the web printable substrate B supported on the central impression cylinder 1.

Although the auxiliary frame 7 could be made as one part, for manufacture easiness purposes the auxiliary frame 7 is advantageously comprised of a plurality of modular auxiliary frame parts 71-74 staked on one another, wherein each modular auxiliary frame part 71-74 carries one of the offset inking units 4, although there is no limitation for one or more of the auxiliary frame parts 71-74 to carry more than one offset inking units 4. The stacked modular auxiliary frame parts 71-74 are staggered so as to follow the circumference of the central impression cylinder 1 and connected to each other by releasable fastening means 36. Thus, the stacked modular auxiliary frame parts 71-74 forming each the auxiliary frame 7 can be moved as one unit between their withdrawn and working positions.

Advantageously, although it is not essential, all the eight auxiliary frame parts 71-74 are identical design and symmetrically located with respect to a central vertical plane Cvp comprising the axis of the central impression cylinder. The arrangement of the components of the offset inking units 4 installed on the four auxiliary frame parts 71-74 located at the web inlet side is identical and the arrangement of the components of the offset inking units 4 installed on the four auxiliary frame parts 71-74 located at the web inlet side is identical, but due to the switch of the web-pass direction, downwards at the web inlet side and downwards at the web outlet side, the offset inking units 4 at the web inlet side are not internally identical to the offset inking units 4 at the web outlet side.

Figure 5:
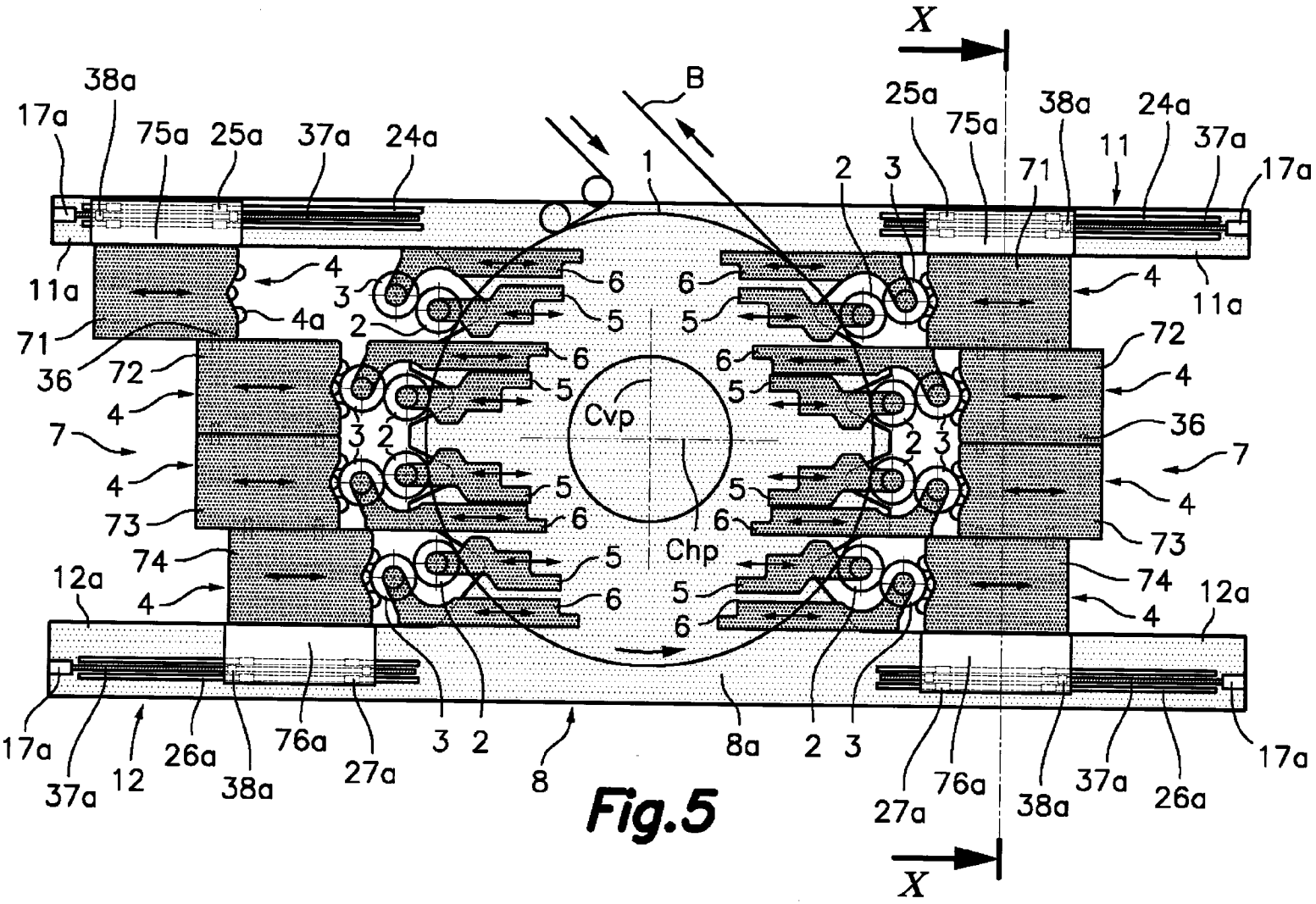
FIG. 5 is a diagrammatic operator side view of the printing machine with all the printing stations in the working position except the first one, the offset inking unit of which is in the withdrawn position.

As shown in FIG. 5, by momentarily releasing the aforementioned releasable fastening means 36, the modular auxiliary frame parts 71-74 are individually movable so that the position of one or more of said staked modular auxiliary frame parts 71-74, for example the one carrying the uppermost inking unit 4 in one or both auxiliary frames 7, can be shifted away from the central impression cylinder 1 with respect to the rest of the staked modular auxiliary frame parts 71-74 forming the auxiliary frame 7. Then the shifted modular auxiliary frame part 71-74 can be connected again to the rest of modular auxiliary frame parts 71-74 using the releasable fastening means 36 to form the auxiliary frame 7. Thus, the shifted modular auxiliary frame part 71-74 provides sufficient room for an alternative inking unit to be mounted in the corresponding printing station while the rest of modular auxiliary frame parts 71-74 are located with their offset inking units 4 in the working positions.

Alternativelly or additionally, one or more of the stacked modular auxiliary frame parts 71-74 on which offset inking units 4 are mounted can be replaced with dummy modular auxiliary frame parts (not shown) to allow a limited number of printing stations instead of the maximum possible number and/or to allow space for additional drying or curing equipment.

FIG. 1 shows the printing machine with the printing stations in one of its working positions, where the blanket cylinders 2 supported on the individual first supports 5 are rolling in contact with the web printable substrate B supported on the central impression cylinder 1, the plate cylinders 3 supported on the individual second supports 6 are rolling in contact with the corresponding blanket cylinders 2 and said plurality of inking rollers 4*a* of the offset inking units 4 supported on the two auxiliary frames 7 located at both web inlet side and web outlet side are rolling in contact with the corresponding plate cylinder 3. The different working positions are selected to accommodate pairs of blanket and plate cylinders 2, 3 of different diameters. For requirements of the offset printing technique, the diameter of the blanket cylinder 2 and the diameter of the plate cylinder 3 need to be identical to each other and in all the printing stations, so that said diameter determines the printing repeat length on the web printable substrate B.

FIG. 2 shows the printing machine with the printing stations in the withdrawn positions, in which the blanket cylinder 2 of each printing station is away from the central impression cylinder 1, the plate cylinder 3 is away from the blanket cylinder 2 and the offset inking unit 4 is away from the plate cylinder 3. When the offset inking units 4 are in their working positions, the auxiliary frames 7 are spaced apart from the first and second supports 5, 6 enough to permit easy access of an operator between the auxiliary frames 7 and the first and second supports 5, 6 irrespective of the withdrawn or working positions of the first and second supports 5, 6 and the diameter of the pairs of blanket and plate cylinders 2, 3 installed thereon. Thus, the operator in charge of inspection or maintenance has a clear access to the rollers and other components of the offset inking units 4 and to the blanket and plate cylinders 2, 3 of all the printing stations located at the corresponding web inlet side or web outlet side.

FIG. 3 shows the first and second supports 5, 6 carrying the respective blanket and plate cylinders 2, 3 in the first and the second offset printing stations with respect to the movement direction of the web printable substrate (at the upper part of the web inlet side), in a first working position adjusted to accommodate and work with pairs of blanket and plate cylinders 2, 3 having the minimum admissible diameter for a minimum repeat length.

FIG. 4 shows the same components of the first and the second offset printing stations in a second working position in which the respective first and second supports 5, 6 are positioned in a second working position to accommodate and work with pairs of blanket and plate cylinders 2, 3 having the maximum admissible diameter for a maximum repeat length. The first and second supports 5, 6 can be placed in any intermediate working position between said first and second working positions to accommodate and work with pairs of blanket and plate cylinders 2, 3 of intermediate diameters. The auxiliary frame 7 and corresponding offset inking units 4 are omitted from FIGS. 3 and 4 for clarity.

Although it is not essential, in the exemplary embodiment shown in the Figures, the first supports 5 and the second supports 6 of all the eight printing stations are advantageously identical design and symmetrically positioned both with respect to a central horizontal plane Chp and to a central vertical plane Cvp both comprising the axis of the central impression cylinder 1. Therefore, the first and second offset printing stations shown in FIGS. 3 and 4 are representative of the rest of the printing stations in regard of the effects of the horizontal positioning linear movements of their first and second supports 5, 6 and the relative positions of the central impression cylinder 1, blanket cylinder 2 and plate cylinder 3 for different formats.

As shown in FIGS. 3 and 4, in each printing station a first horizontal plane Hp1 in which the axis of the blanket cylinder 2 is moved by the first support 5 is nearer from said central horizontal plane Chp than a second horizontal plane Hp2 in which the axis of the plate cylinder 3 is moved by the second support 6. This means that the axis of the blanket cylinder 2 and the axis of the plate cylinder 3 are comprised in a common inclined first plane P1 when the pair of blanket and plate cylinders 2, 3 are in a working position and for any diameter thereof between said minimum and maximum diameters. The inclination degree of said first plane P1 varies with the diameter of the pair of blanket and plate cylinders 2, 3 due to the linear positioning movement of the first and second supports 5, 6 in the different first and second horizontal planes Hp1, Hp2.

Owing to the arrangement of the printing stations around the central impression cylinder, in each printing station the axis of the central impression cylinder 1 and the axis of the blanket cylinder 2 are comprised in a common inclined second plane P2 when the blanket cylinder 2 is in a working position and for any diameter thereof between said minimum and maximum diameters. The inclination degree of said second plane P2 varies depending on the farther or nearer position of the corresponding printing station with respect to said central horizontal plane Chp and on the diameter of the blanket cylinder 2 due to the linear positioning movement of the first support 5 in the first horizontal plane Hp1.

In order to reduce or minimize the effect produced by the gap-bounce in the quality of printing, the design of the first and second supports 5, 6 and the arrangement thereof in all of the printing stations is selected such that an angle A between the first and second planes P1, P2 does not exceed 20° regardless the position of the corresponding printing station with respect to the central horizontal plane Chp and for any diameter of the pair of blanket and plate cylinders 2, 3 installed therein between a minimum diameter (FIG. 3) and a maximum diameter (FIG. 4). Said angle A ranging from 0° to 20° and more preferably from 0° to 15° is considered to be acceptable in regard of the gap-bounce effect because it does not produce an appreciable negative consequence in the quality of printing.

By way of illustration only, in the particular embodiment shown in the Figures said angle A for the printing stations farthest from the central impression cylinder 1 ranges from 3.42° for the minimum format (FIG. 3) to 11.58° for the maximum format (FIG. 4), with an intermediate working position for a particular intermediate format (not shown) where the angle A is 0°, i.e. the axis of the central impression cylinder 1, blanket cylinder 2 and plate cylinder 3 are comprised in one and the same plane. The angle A for the printing stations nearer from the central impression cylinder 1 ranges from 11.56° for the minimum format (FIG. 3) to 1.51° for the maximum format (FIG. 4).

There is an exception when a printing station (not shown) is optionally positioned such that the axes of the blanket and the plate cylinders are both moved by the respective first and second supports in the central horizontal plane Chp comprising the axis of the central impression cylinder 1. In this case, the aforementioned first and second planes are a common horizontal plane and the angle therebetween is 0° for all working positions of the pair of blanket and plate cylinders and for any diameter thereof between said minimum and maximum diameters, which is an ideal situation in regard of the gap-bounce effect.

Figure 6:
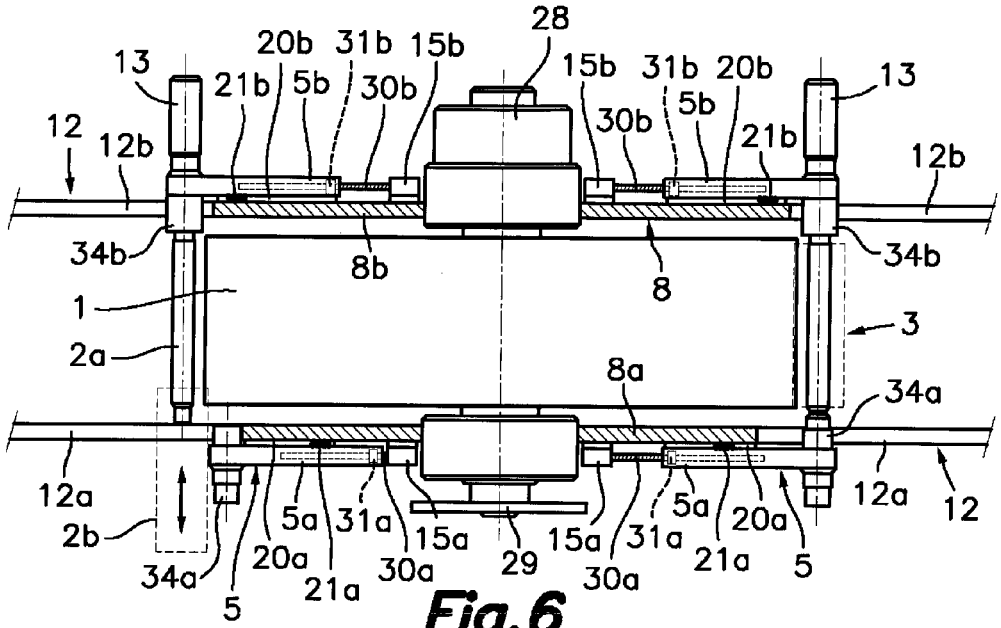
FIG. 6 is a partial cross-sectional view taken along the plane VI-VI of FIG. 2 showing the construction of the main frame supporting the central impression cylinder and one of the first supports carrying a blanket cylinder.

As best shown in FIGS. 6, 7 and 8, the aforementioned main frame 8 of the printing machine comprises an operator side main frame wall 8*a* and a gear side main frame wall 8*b* respectively located at a gear side and an operator side of the printing machine adjacent opposite ends of the central impression cylinder 1. Said operator side and gear side main frame walls 8*a*, 8*b* have respective middle regions on which the central impression cylinder 1 is rotatingly supported and operator side and gear side upper and lower beams 11*a*, 11*b*; 12*a*, 12*b* horizontally extending from said middle regions of the operator side and gear side main frame walls 8*a*, 8*b* and solidly connected thereto. On the gear side main frame wall 8*b* there is supported a main motor 28 connected for rotating the central impression cylinder 1 and at the operator side main frame wall 8*a* there is supported a brake 29 connected for braking the central impression cylinder 1. The operator side of the printing machine is shown in FIGS. 1-5 and 9.

As shown in FIG. 6, each of the first supports 5 carrying one blanket cylinder 2 comprises an operator side first support 5*a* and a gear side first support 5*b* carrying respective support means 34*a*, 34*b* such as roll bearings or the like for rotatingly supporting a blanket mandrel 2*a* on which a blanket sleeve 2*b* (depicted with phantom lines in FIG. 6) is mounted. Said blanket mandrel 2*a* and blanket sleeve 2*b* form together the corresponding blanket cylinder 2. The support means 34*b* at the gear side first support 5*b* are capable of supporting said mandrel in cantilever and the support means 34*a* at the operator side first support 5*a* can be opened and spaced apart by individually moving the operator side first support 5*a* for enabling the blanket sleeve 2*b* to be axially installed or removed from the blanket mandrel 2*a* through the machine operator side (as shown in the left side of FIG. 6). A blanket cylinder-driving servomotor 13 is carried on said gear side first support 5*b* and connected for driving the rotating movement of the blanket cylinder 2.

The operator side first support 5*a* is directly connected to the middle region of the operator side main frame wall 8*a* by linear guidance means comprising, for example, two parallel linear rails 20*a* attached to the operator side main frame wall 8*a* and corresponding slides 21*a* attached to the operator side first support 5*a* and slidingly connected to said linear rails 20*a*. A gear side first support-driving motor 15*a*, such as a servomotor, is supported on the operator side main frame wall 8*a* and connected to rotate a roller screw spindle 30*a* coupled to a nut 31*a* attached to the operator side first support 5*a*. Said roller screw spindle 30*a* is parallel to the two linear rails 20*a* and located between both (see also FIG. 8).

In a similar way, the gear side first support 5*b* is directly connected to the middle region of the gear side main frame wall 8*b* by linear guidance means comprising, for example, two parallel linear rails 20*b* attached to the gear side first support 5*b* and corresponding slides 21*b* attached to the gear side main frame wall 8*b* and slidingly connected to said linear rails 20*b*. A gear side first support-driving motor 15*b*, such as a servomotor, is supported on the gear side main frame wall 8*b* and connected to rotate a roller screw spindle 30*b* coupled to a nut 31*b* attached to the gear side first support 5*b*. Said roller screw spindle 30*b* is parallel to the two linear rails 20*b* and located between both (see also FIG. 8).

The operator side and gear side first support-driving motors 15*a*, 15*b* can be individually activated to move the operator side and gear side first supports 5*a*, 5*b* either in unison for shifting the blanket cylinder 2 between the withdrawn and working positions or independently from one another, for example for enabling a change of format or for cylinder's relative positioning adjustment.

Similarly, as shown in FIG. 7, each of the second supports 6 carrying one plate cylinder 3 comprises an operator side second support 6*a* and a gear side second support 6*b* carrying respective support means 35*a*, 35*b* such as roll bearings or the like for rotatingly supporting a plate mandrel 3*a* on which a plate sleeve 3*b* (depicted with phantom lines in FIG. 7) is mounted. Said plate mandrel 3*a* and plate sleeve 3*b* form together the corresponding plate cylinder 3. The support means 35*b* at the gear side second support 6*b* are capable of supporting said mandrel in cantilever and the support means 35*a* at the operator side second support 6*a* can be opened and spaced apart by individually moving the operator side second support 6*a* for enabling the plate sleeve 3*b* to be axially installed or removed from the plate mandrel 3*a* through the machine operator side (as shown in the left side of FIG. 7). A plate cylinder-driving servomotor 14 is carried on said gear side second support 6*b* and connected for driving the rotating movement of the plate cylinder 3.

The operator side second support 6*a* is directly connected to the middle region of the operator side main frame wall 8*a* by linear guidance means comprising, for example, two parallel linear rails 22*a* attached to the operator side second support 6*a* and corresponding slides 23*a* attached to the operator side main frame wall 8*a* and slidingly connected to said linear rails 22*a*. A gear side second support-driving motor 16*a*, such as a servomotor, is supported on the operator side main frame wall 8*a* and connected to rotate a roller screw spindle 32*a* coupled to a nut 33*a* attached to the operator side second support 6*a*. Said roller screw spindle 32*a* is parallel to the two linear rails 22*a* and located between both (see also FIG. 8).

In a similar way, the gear side second support 6*b* is directly connected to the middle region of the gear side main frame wall 8*b* by linear guidance means comprising, for example, two parallel linear rails 22*b* attached to the gear side second support 6*b* and corresponding slides 23*b* attached to the gear side main frame wall 8*b* and slidingly connected to said linear rails 22*b*. A gear side second support-driving motor 16*b*, such as a servomotor, is supported on the gear side main frame wall 8*b* and connected to rotate a roller screw spindle 32*b* coupled to a nut 33*b* attached to the gear side second support 6*b*. Said roller screw spindle 32*b* is parallel to the two linear rails 22*b* and located between both (see also FIG. 8).

The operator side and gear side second support-driving motors 16*a*, 16*b* can be individually activated to move the operator side and gear side second supports 6*a*, 6*b* either in unison for shifting the plate cylinder 3 between the withdrawn and working positions or independently from one another, for example for enabling a change of format or for cylinder's relative positioning adjustment.

Figure 9:
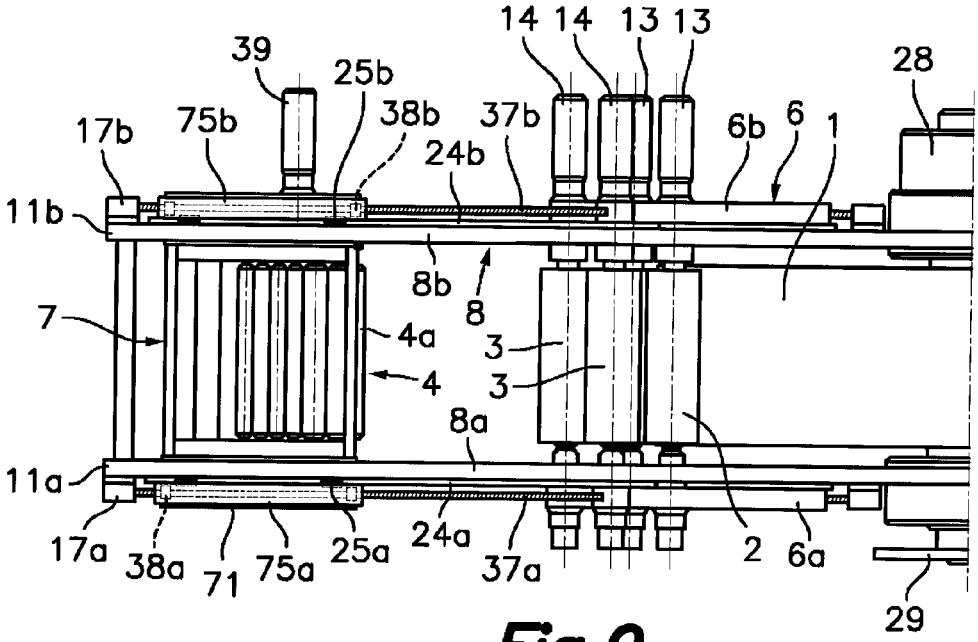
FIG. 9 is a partial plant view showing the construction of the main frame supporting the central impression cylinder and an auxiliary frame carrying a plurality of offset inking units supported on beams of the main frame.
Figure 10:
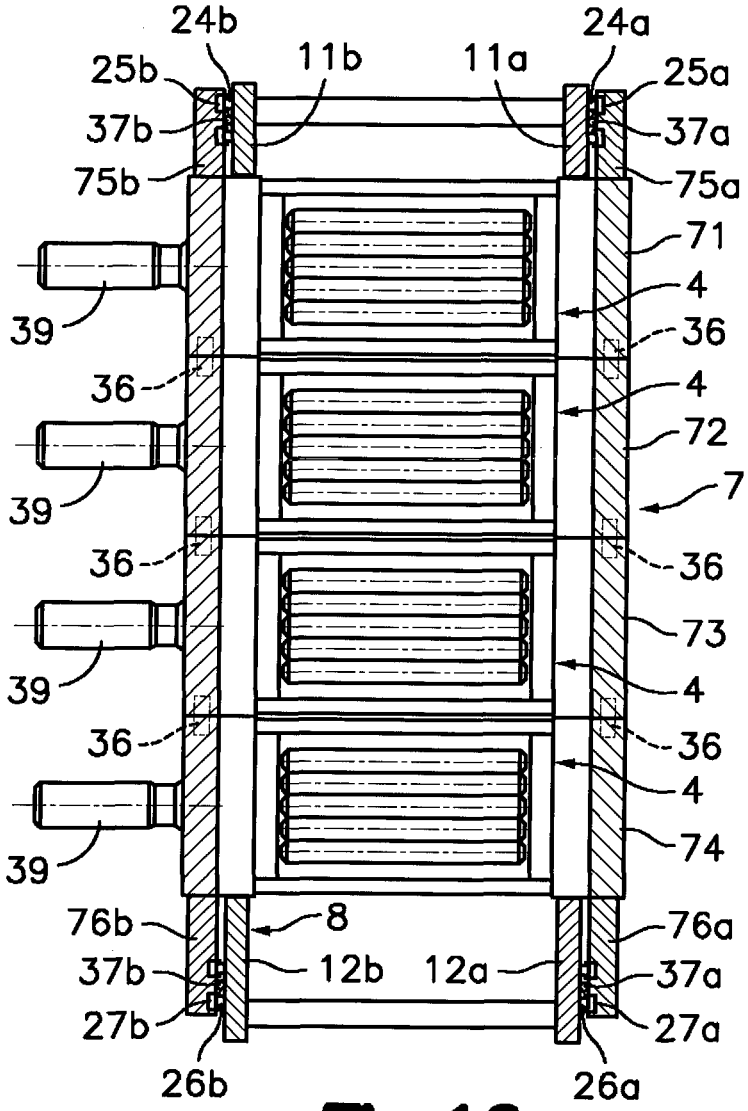
FIG. 10 is a cross-sectional view taken along the plane X-X of FIG. 5, showing the construction of the main frame and the auxiliary frame.

FIGS. 9 and 10, together with FIG. 5, show the construction of the auxiliary frame 7. There is shown the operator side and gear side main frame walls 8*a*, 8*b* of the main frame 8 supporting the central impression cylinder 1, the first support 5 carrying the blanket cylinder 2, the second support 6 carrying the plate cylinder 3, and the auxiliary frame 7 carrying the offset inking units 4. At the gear side of the auxiliary frame 7 motors 39 are arranged for rotating the inking rollers 4*a* and other rollers of the offset inking units 4. The auxiliary frame 7 at the web outlet side is similar to that at the web inlet side.

The auxiliary frame 7, which in the illustrated embodiment is formed by the auxiliary frame parts 71-74 connected to each other, is attached at its operator side to operator side upper and lower auxiliary frame-carriers 75*a*, 76*a* respectively connected by operator side upper and lower horizontal linear guidance means 24*a*, 25*a*; 26*a*, 27*a* to operator side upper and lower beams 11*a*, 12*a* extending from the middle region of the operator side main frame wall 8*a* of the main frame 8 (see also FIG. 5). Similarly, the auxiliary frame 7 is attached at its gear side to gear side upper and lower auxiliary frame-carriers 75*b* connected by third gear side upper and lower horizontal linear guidance means 24*b*, 25*b* respectively to the gear side upper and lower beams 11*b*, 12*b* extending from the middle region of the gear side main frame wall 8*a* of the main frame 8.

Said operator side upper and lower horizontal linear guidance means comprise two parallel upper linear rails 24*a* and two parallel lower linear rails 26*a* respectively attached to the corresponding operator side upper and lower beams 11*a*, 12*a*, and upper and lower slides 25*a*, 27*a* which are attached to the corresponding operator side upper and lower auxiliary frame-carriers 75*a*, 76*a* and slidingly connected to said upper and lower linear rails 24*a*, 26*a*, respectively. Operator side auxiliary frame-driving motors 17*a*, such as servomotors, are supported on the operator side upper and lower beams 11*a*, 12*a* and connected to rotate respective roller screw spindles 37*a* coupled to respective nuts 38*a* attached to the corresponding operator side upper and lower auxiliary frame-carriers 75*a*, 76*a*, said roller screw spindles 37*a* being parallel to the corresponding two parallel upper and lower linear rails 24*a*, 26*a* and located between both.

Similarly, Said gear side upper and lower horizontal linear guidance means comprise two parallel upper linear rails 24*b* and two parallel lower linear rails 26*b* respectively attached to the gear side upper and lower beams 11*b*, 12*b*, and gear side upper and lower slides 25*b*, 27*b* which are attached to the corresponding gear side upper and lower auxiliary frame-carriers 75*b* and slidingly connected to said gear side upper and lower linear rails 24*b*, 26*b*, respectively. Gear side auxiliary frame-driving motors 17*b*, such as servomotors, are supported on the gear side upper and lower beams 11*b*, 12*b* and connected to rotate respective roller screw spindles 37*a* coupled to respective nuts 38*b* attached to the corresponding gear side upper and lower auxiliary frame-carriers 75*b*, said roller screw spindles 37*b* being parallel to the corresponding two parallel upper and lower linear rails 24*b*, 26*b* and located between both.

By activating in unison the operator side and gear side auxiliary frame-driving motors 17*a*, 17*b*, the four auxiliary frame-carriers 75*a*, 76*a* are moved together for shifting the auxiliary frame 7 formed by the auxiliary frame parts 71-74 and the offset inking units 4 installed thereon between the withdrawn and working positions. When some of the releasable fastening means 36 are released, by activating only the upper or lower auxiliary frame-driving motors 17*a*, 17*b* corresponding to one of the auxiliary frame 7 located at the machine web inlet or web outlet side it is possible to shift the position of one or more auxiliary frame parts 71-74 with respect to the rest of them in the stack.

Modifications and variations will readily occur to one skilled in the art without departing from the scope of the present invention as defined in the attached claims.

The invention claimed is:

1. A variable format offset printing machine having a central impression cylinder, said printing machine comprising said central impression cylinder (1) on which a web printable substrate (B) is supported and a plurality of printing stations arranged around the central impression cylinder (1), each of said printing stations comprising a blanket cylinder (2) of variable diameter, a plate cylinder (3) of variable diameter, and an offset inking unit (4), said blanket cylinder (2), plate cylinder (3) and offset inking unit (4) being movable between respective withdraw positions and respective multiple working positions for different diameters of the blanket and plate cylinders (2, 3), characterized in that in at least one of said printing stations:

the axis of the blanket cylinder (2) and the axis of the plate cylinder (3) are comprised in a first plane (P1) inclined with respect to a horizontal plane, wherein said first plane (P1) does not comprise the axis of the central impression cylinder (1) at several of said multiple working positions for different diameters of the blanket and plate cylinders (2, 3);

the axis of the blanket cylinder (2) and the axis of the plate cylinder (3) are movable in respective first and second horizontal planes (Hp1, Hp2); and said first plane (P1) forms an angle (A) ranging from 0° to 20° in absolute value with a second plane (P2) comprising the axis of the central impression cylinder (1) and the axis of the blanket cylinder (2) at any of said multiple working positions for different diameters of the blanket and plate cylinders (2, 3).

2. The printing machine according to claim 1, characterized in that the blanket cylinder (2) and the plate cylinder (3) are rotatingly supported on respective first and second supports (5, 6) connected to a main frame (8) rotatingly supporting the central impression cylinder (1) by respective first and second linear guidance means.

3. The printing machine according to claim 2, characterized in that said first and second linear guidance means are first and second horizontal guidance means.

4. The printing machine according to claim 2, characterized in that in all the printing stations are located above and below a central horizontal plane (Chp), said first supports (5) are identical design and symmetrically positioned both with respect to said central horizontal plane (Chp) and to a central vertical plane (Cvp) and said second supports (6) are identical design and symmetrically positioned both with respect to the central horizontal plane (Chp) and to said central vertical plane (Cvp).

5. The printing machine according to claim 2, characterized in that the main frame (8) has opposite operator and gear sides, and each first support (5) comprises an operator side first support (5*a*) and a gear side first support (5*b*) independently movable from each other, and each second support (6) comprises an operator side second support (6*a*) and a gear side second support (6*b*) independently movable from each other.

6. The printing machine according to claim 2, characterized in that the main frame (8) has opposite web inlet and web outlet sides, and the offset inking units (4) of all the printing stations which are located at one and the same web inlet or web outlet side of the central impression cylinder (1) are mounted on at least one auxiliary frame (7) in which the offset inking units (4) are superposed on one another and staggered so as to follow the circumference of the central impression cylinder (1), said auxiliary frame (7) being movable in a linear horizontal direction between withdrawn and working positions.

7. The printing machine according to claim 6, characterized in that the auxiliary frame (7) when is in its withdrawn position provides a space between the same auxiliary frame (7) and all the first and second supports (5, 6) located at the same web inlet or web outlet side of the main frame (8) permitting access for an operator therein.

8. The printing machine according to claim 6, characterized in that the uppermost and lowermost offset inking units (4) are attached to upper and lower auxiliary frame-carriers 75*a*, 76*a*, which are movable connected to upper and lower beams (11, 12) extending from a middle region of the main frame (8).

9. The printing machine according to claim 8, characterized in that the position of at least said staked uppermost offset inking unit (4) is shiftable with respect to the rest of the staked offset inking units (4) forming the auxiliary frame (7).

10. The printing machine according to claim 8, characterized in that one or more of the stacked modular offset inking units (4) is replaced with dummy modular auxiliary units to allow a limited number of printing stations instead of the maximum possible number and/or to allow space for additional drying or curing equipment.

11. The printing machine according to claim 8, characterized in that any of the stacked modular offset inking units (4) forming the auxiliary frame (7) is individually movable between their withdrawn and working positions.

12. The printing machine according to claim 1, characterized in that at least one of the printing stations comprises an alternative inking unit.

13. The printing machine according to claim 3, characterized in that the main frame (8) has opposite web inlet and web outlet sides, and the offset inking units (4) of all the printing stations which are located at one and the same web inlet or web outlet side of the central impression cylinder (1) are mounted on at least one auxiliary frame (7) in which the offset inking units (4) are superposed on one another and staggered so as to follow the circumference of the central impression cylinder (1), said auxiliary frame (7) being movable in a linear horizontal direction between withdrawn and working positions.

14. The printing machine according to claim 4, characterized in that the main frame (8) has opposite web inlet and web outlet sides, and the offset inking units (4) of all the printing stations which are located at one and the same web inlet or web outlet side of the central impression cylinder (1) are mounted on at least one auxiliary frame (7) in which the offset inking units (4) are superposed on one another and staggered so as to follow the circumference of the central impression cylinder (1), said auxiliary frame (7) being movable in a linear horizontal direction between withdrawn and working positions.

15. The printing machine according to claim 5, characterized in that the main frame (8) has opposite web inlet and web outlet sides, and the offset inking units (4) of all the printing stations which are located at one and the same web inlet or web outlet side of the central impression cylinder (1) are mounted on at least one auxiliary frame (7) in which the offset inking units (4) are superposed on one another and staggered so as to follow the circumference of the central impression cylinder (1), said auxiliary frame (7) being movable in a linear horizontal direction between withdrawn and working positions.

16. The printing machine according to claim 9, characterized in that one or more of the stacked modular offset inking units (4) is replaced with dummy modular auxiliary units to allow a limited number of printing stations instead of the maximum possible number and/or to allow space for additional drying or curing equipment.

17. The printing machine according to claim 9, characterized in that any of the stacked modular offset inking units (4) forming the auxiliary frame (7) is individually movable between their withdrawn and working positions.

18. The printing machine according to claim 10, characterized in that any of the stacked modular offset inking units (4) forming the auxiliary frame (7) is individually movable between their withdrawn and working positions.

* * * * *